US008708844B2

(12) United States Patent
Nye et al.

(10) Patent No.: US 8,708,844 B2
(45) Date of Patent: Apr. 29, 2014

(54) BASKETBALL SYSTEM

(75) Inventors: S. Curtis Nye, Clinton, UT (US); L. Curtis Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 480 days.

(21) Appl. No.: 11/625,677

(22) Filed: Jan. 22, 2007

(65) Prior Publication Data

US 2007/0191151 A1 Aug. 16, 2007

Related U.S. Application Data

(60) Provisional application No. 60/760,876, filed on Jan. 20, 2006.

(51) Int. Cl.
*A63B 63/08* (2006.01)

(52) U.S. Cl.
USPC ..... 473/484

(58) Field of Classification Search
USPC ..... 473/479, 481, 483, 484
See application file for complete search history.

(56) References Cited

U.S. PATENT DOCUMENTS

| | | | | |
|---|---|---|---|---|
| 2,321,378 A | | 6/1943 | Green | |
| 3,025,058 A | | 3/1962 | Brumfield | |
| 4,145,044 A | | 3/1979 | Wilson | |
| 4,185,936 A | | 1/1980 | Takahashi | |
| 4,285,518 A | * | 8/1981 | Pearo | 473/481 |
| 4,424,968 A | | 1/1984 | Smith | |
| 4,465,277 A | | 8/1984 | Dittrich | |
| 4,723,777 A | | 2/1988 | Jolly | |
| 4,762,319 A | | 8/1988 | Krumholz | |
| 4,781,375 A | | 11/1988 | Nye | |
| 4,805,904 A | | 2/1989 | Nye | |
| 4,881,734 A | | 11/1989 | Nye | |
| 5,037,092 A | * | 8/1991 | Blackburn | 473/481 |
| 5,106,084 A | * | 4/1992 | Vaught | 473/486 |

(Continued)

FOREIGN PATENT DOCUMENTS

| | | |
|---|---|---|
| CN | 2640548 | 9/2004 |
| CN | 200880000008 | 12/2010 |

(Continued)

OTHER PUBLICATIONS

U.S. Appl. No. 11/500,971, filed Aug. 7, 2006, Nye.

(Continued)

*Primary Examiner* — Gene Kim
*Assistant Examiner* — Amir Klayman
(74) *Attorney, Agent, or Firm* — Workman Nydegger

(57) ABSTRACT

A basketball system may include a support structure that is sized and configured to support a basketball goal above a playing surface. The basketball system may also include a connecting structure that interconnects the basketball goal and the support structure. For example, the connecting structure may include a first pair of arms with one end connected to the basketball goal and another end connected to the support structure. The connecting structure may also include a second pair of arms with one end connected to the basketball goal and a rim assembly, and the other end connected to the support structure. The connecting structure may further include a third pair of arms with a first end connected to the rim assembly and a second end connected to the support structure. The third pair of arms is preferably disposed between the first pair of arms and the second pair of arms.

22 Claims, 7 Drawing Sheets

(56) References Cited

U.S. PATENT DOCUMENTS

| | | | | | |
|---|---|---|---|---|---|
| 5,112,023 | A | | 5/1992 | Sowers | |
| 5,114,141 | A | * | 5/1992 | Mahoney | 473/481 |
| 5,120,054 | A | | 6/1992 | Wetzel | |
| 5,133,547 | A | | 7/1992 | Pardi | |
| 5,154,414 | A | | 10/1992 | Auer | |
| 5,165,565 | A | | 11/1992 | Schlessmann | |
| 5,207,407 | A | | 5/1993 | Fitzsimmons | |
| 5,248,140 | A | | 9/1993 | Matherne | |
| 5,259,612 | A | | 11/1993 | Matherne | |
| 5,324,027 | A | * | 6/1994 | Nye | 473/484 |
| 5,375,835 | A | | 12/1994 | Van Nimwegen et al. | |
| 5,377,976 | A | | 1/1995 | Matherne | |
| 5,415,393 | A | | 5/1995 | Fitzsimmons | |
| 5,489,107 | A | | 2/1996 | Kho | |
| 5,556,088 | A | | 9/1996 | Mower | |
| 5,573,237 | A | | 11/1996 | Van Nimwegen et al. | |
| 5,586,759 | A | * | 12/1996 | Fitzsimmons et al. | 473/486 |
| 5,695,417 | A | | 12/1997 | Winter | |
| 5,730,668 | A | | 3/1998 | Hege | |
| 5,738,601 | A | | 4/1998 | Hughes | |
| 5,816,955 | A | | 10/1998 | Nordgran | |
| 5,830,090 | A | * | 11/1998 | Fitzsimmons et al. | 473/486 |
| 5,839,982 | A | | 11/1998 | Hying | |
| 5,879,247 | A | | 3/1999 | Winter et al. | |
| 6,004,231 | A | | 12/1999 | Schickert | |
| 6,042,297 | A | | 3/2000 | Lah | |
| 6,053,826 | A | * | 4/2000 | Koole | 473/485 |
| 6,077,177 | A | | 6/2000 | Winter et al. | |
| 6,120,396 | A | | 9/2000 | VanNimwegen et al. | |
| 6,135,901 | A | | 10/2000 | VanNimwegen | |
| 6,142,891 | A | | 11/2000 | Winter et al. | |
| 6,145,856 | A | | 11/2000 | Conti | |
| 6,155,938 | A | | 12/2000 | Mower | |
| 6,186,911 | B1 | * | 2/2001 | Manthey | 473/486 |
| 6,273,834 | B1 | | 8/2001 | Winter | |
| 6,283,878 | B1 | | 9/2001 | White | |
| 6,334,822 | B1 | | 1/2002 | Zider | |
| 6,367,948 | B2 | | 4/2002 | Branson | |
| 6,402,644 | B2 | | 6/2002 | Stanford et al. | |
| 6,419,597 | B1 | | 7/2002 | VanNimwegen et al. | |
| 6,419,598 | B1 | | 7/2002 | Winter et al. | |
| 6,422,957 | B1 | | 7/2002 | Winter et al. | |
| 6,432,003 | B1 | | 8/2002 | Van Nimwegen et al. | |
| 6,468,373 | B1 | | 10/2002 | Grinwald | |
| 6,488,599 | B2 | | 12/2002 | Nye | |
| 6,645,095 | B1 | | 11/2003 | Nye et al. | |
| D484,200 | S | | 12/2003 | Nye | |
| 6,656,065 | B2 | | 12/2003 | Nye | |
| D484,933 | S | | 1/2004 | Stanford | |
| 6,699,146 | B1 | | 3/2004 | Winter et al. | |
| 6,758,768 | B2 | | 7/2004 | Spencer | |
| D498,800 | S | | 11/2004 | Nye | |
| 6,824,481 | B1 | | 11/2004 | Nye | |
| D503,441 | S | | 3/2005 | Stanford | |
| 6,866,596 | B2 | | 3/2005 | Steed | |
| 6,881,162 | B2 | | 4/2005 | Nye | |
| 6,916,257 | B1 | | 7/2005 | Van Nimwegen et al. | |
| 6,994,502 | B2 | | 2/2006 | Winter | |
| 7,001,290 | B2 | | 2/2006 | Mower | |
| 7,044,867 | B2 | | 5/2006 | Van Nimwegen et al. | |
| 7,048,655 | B2 | | 5/2006 | Nye | |
| 7,052,418 | B2 | | 5/2006 | Nye | |
| 7,097,574 | B2 | | 8/2006 | Nye | |
| 7,118,500 | B2 | | 10/2006 | Nye | |
| D532,466 | S | | 11/2006 | Nye | |
| 7,195,571 | B2 | | 3/2007 | Nye | |
| 7,604,555 | B2 | | 10/2009 | Nye | |
| 7,691,014 | B2 | | 4/2010 | Nye | |
| 7,691,015 | B2 | | 4/2010 | Nye | |
| 7,775,917 | B2 | | 8/2010 | Nye | |
| 8,062,152 | B2 | | 11/2011 | Nye | |
| 8,172,706 | B2 | | 5/2012 | Peery | |
| 8,348,788 | B2 | | 1/2013 | Nye | |
| 2001/0024984 | A1 | * | 9/2001 | Stanford et al. | 473/484 |
| 2006/0116225 | A1 | * | 6/2006 | Kilpatrick | 473/483 |
| 2008/0039242 | A1 | | 2/2008 | Nye | |
| 2009/0069130 | A1 | | 3/2009 | Nye et al. | |

FOREIGN PATENT DOCUMENTS

| | | |
|---|---|---|
| CN | 200880000008 | 10/2011 |
| EP | 12174326 | 10/2012 |
| EP | 12174326 | 1/2013 |

OTHER PUBLICATIONS

U.S. Appl. No. 11/836,121, filed Aug. 8, 2007, Nye.
U.S. Appl. No. 13/403,226, filed Feb. 23, 2012, Astle.
U.S. Appl. No. 13/253,762, filed Oct. 5, 2011, Nye.
U.S. Appl. No. 11/863,121, filed Aug. 8, 2007, Nye.
U.S. Appl. No. 13/533,714, filed Jun. 26, 2012, Green.
Spalding Equipment—2500 Portable Backstop, Recreational Portables; www.spaldingequipment.com/products; Jun. 25, 2012.
U.S. Appl. No. 11/836,121, Jun. 1, 2009, Office Action.
U.S. Appl. No. 11/836,121, Mar. 5, 2010, Final Office Action.
U.S. Appl. No. 11/836,121, Jul. 25, 2011, Office Action.
U.S. Appl. No. 11/836,121, Dec. 7, 2011, Final Office Action.
U.S. Appl. No. 13/253,762, Jan. 20, 2012, Office Action.
U.S. Appl. No. 13/253,762, Jun. 1, 2012, Final Office Action.
U.S. Appl. No. 12/192,046, Aug. 4, 2010, Office Action.
U.S. Appl. No. 12/192,046, Apr. 4, 2011, Final Office Action.
U.S. Appl. No. 12/192,046, Jun. 23, 2011, Advisory Action.
U.S. Appl. No. 12/192,046, Jul. 18, 2011, Notice of Allowance.
U.S. Appl. No. 11/836,121, Dec. 28, 2012, Office Action

* cited by examiner

BASKETBALL SYSTEM

CROSS-REFERENCE TO RELATED APPLICATIONS

This application claims priority to and the benefit of U.S. Provisional Patent Application Ser. No. 60/760,876, entitled Basketball System, which was filed on Jan. 20, 2006, and is hereby incorporated by reference in its entirety.

BACKGROUND OF THE INVENTION

1. Field of the Invention

The present invention generally relates to basketball systems and, in particular, to support structures that may be used in connection with basketball systems.

2. Description of Related Art

The game of basketball is played by many people throughout the world. Briefly, the game of basketball typically includes a flat and level playing surface with a basketball goal at each end of a court. The basketball goal, which may include a backboard and a rim or hoop, is typically attached to the top of a support pole. The rim or hoop is normally located ten feet above the playing surface, which is the regulation height for playing basketball. The rim is typically constructed from metal and it is known to construct the backboard from materials such as wood, tempered glass and plastic.

Conventional basketball goals typically include the backboard positioned perpendicular to the playing surface and the rim positioned parallel to the playing surface. The rim of many conventional basketball goals is rigidly mounted to the basketball backboard. It is also known to pivotally connect the rim to the backboard, which may be used to create a movable or break-away type basketball rim.

Known basketball systems may be permanently fixed in a desired location. For example, the basketball system may include a support pole and the end of the support pole may be secured to the ground. This is commonly referred to as an in-ground basketball system. Conventional basketball systems may also be part of a portable basketball system in which the system may be selectively moved from one location to another. For example, a portable basketball system may include a support pole that is connected to a base. The base may include a hollow interior portion that is sized and configured to be filled with ballast such as water or sand. The base may also include wheels to facilitate moving the portable basketball system from one location to another location.

Conventional basketball systems may allow the height of the basketball goal above the playing surface to be adjusted, which may allow the basketball system to be used by a wide variety of persons. For instance, the adjustable height basketball system may be used by relatively tall players for some games and by shorter players during other games. The adjustable height basketball system may also be used by players of different strengths or skill levels. In addition, the adjustable height basketball system may be used by adults or children. Further, the adjustable height basketball system may be used to play a regulation game of basketball or for practicing skills such as dunking the basketball.

A significant amount of force may be applied to conventional basketball systems when the game of basketball is being played or practiced. For example, a significant amount of force may be applied to the rim of the basketball system when a player dunks the basketball or grabs onto the rim. These forces may bend or otherwise damage the rim. In addition, forces applied to the rim may bend or damage other portions of known basketball systems. In particular, the backboards of some conventional basketball systems have been broken when significant forces have been applied to the rim. Additionally, many conventional basketball systems include a frame that supports the backboard and these backboard support frames have been bent or otherwise damaged when significant forces have been applied to the rim. Thus, the rims, backboards and backboard support frames of conventional basketball systems may be damaged or broken if a significant force is applied to the rim.

BRIEF SUMMARY OF EMBODIMENTS OF THE INVENTION

A need therefore exists for a basketball system that eliminates or diminishes the disadvantages and problems described above.

One aspect is a basketball system that may include a basketball goal, which may include a backboard, a rim and a net connected to the rim. The basketball system may also a support structure that is sized and configured to support the basketball goal at a desired height above a playing surface. The support structure may consist of a support pole and the support pole may consist of a single segment or it may consist of multiple segments that are interconnected.

Another aspect is a basketball system that may include a basketball goal that is adjustable in height. For example, the basketball goal may be disposed so that the rim is located ten feet above the playing surface, which is the conventional height for a basketball goal. The basketball goal may also be disposed in other positions so that the rim is located at other heights. In particular, the rim may be located at lower heights, such as nine feet, eight feet, seven feet, six feet, or other desired heights. The rim may also be located at a greater height, if desired. Advantageously, this may allow a wide range of people with different abilities and skills to use the basketball system.

Yet another aspect is a basketball system that may be capable of being disposed in a fixed or permanent location. For example, the basketball system may be an in-ground basketball system. The basketball system may also be a portable basketball system that is sized and configured to be moved from one location to another location. For instance, the basketball system may be connected to a base that is sized and configured to be filled with ballast such as water or sand. The portable basketball system may include wheels to facilitate movement of the basketball system. The portable basketball system may also include a handle that may be used to help move the basketball system from one location to another location.

Still another aspect is a basketball system that may include a connecting structure which connects the basketball goal and the support structure. The connecting structure may include support members or arms that connect the basketball goal and the support structure. The connecting structure preferably includes multiple arms that securely support the basketball backboard and rim. In particular, the connecting structure may include one or more arms that connect the basketball backboard to the support structure. In addition, the connecting structure may include one or more arms that connect the rim to the support structure. The arms may also be movable to allow the height of the basketball goal to be adjusted. For example, the arms may be pivotally connected to the basketball goal and the support structure to allow the height of the basketball goal to be adjusted.

Still yet another aspect is a basketball system that may include a connecting structure that connects the basketball goal to the support structure and a height adjustment mechanism that allows the height of the basketball goal to be adjusted. For example, one end of the height adjustment mechanism may be connected to the support structure and the other end of the height adjustment mechanism may be connected to the connecting structure. The height adjustment mechanism may be sized and configured to move at least a portion of the connecting structure to allow the height of basketball goal to be adjusted.

A further aspect is a basketball system that may include a height adjustment mechanism with a biasing member. The biasing member may be sized and configured to bias the basketball system into a particular location or position. The biasing member may also be sized and configured to bias the basketball system to remain in a particular configuration or location. The biasing member may consist of a spring, gas spring and the like. One end of the biasing member may be connected to the support structure and the other end of the biasing member may be attached to the connecting structure. Advantageously, the biasing member may allow the height of the basketball system to be more easily adjusted.

A still further aspect is basketball system that may include a basketball backboard, which may be constructed as a unitary structure or from multiple components. For example, if the backboard is constructed from multiple components, the backboard may include a frame and a rebound member attached to the frame. The backboard may also include a target area which may facilitate use of the basketball system. For instance, the target area could include a square or rectangular shaped portion that is intended to create a target while shooting a basketball. In addition, the backboard could include an area in which the rim or rim assembly is located. For example, the backboard could include an opening and a portion of the rim assembly could be disposed in the opening, which may allow the rim assembly to be directly connected to the frame and the connecting structure. Advantageously, if the rim or rim assembly is directly connected to the connecting structure, then the amount of forces or stresses transmitted to the rebound member or backboard frame when a force is applied to the rim may be reduced.

Another aspect is a basketball system that may include a connecting structure with multiple pairs of arms or support members that interconnect the support structure and the basketball goal. For example, the connecting structure may include three pairs of arms that interconnect the support structure and the basketball goal. The first pair of arms may connect an upper portion of the backboard and an upper portion of the support structure. The second pair of arms may connect a lower portion of the backboard to a lower portion of the support structure. The second pair of arms may also connect a lower portion of the rim assembly to the lower portion of the support structure. The third pair of arms may be generally disposed between the first and second pairs of arms. The third pair of arms may be connected to an upper portion of the rim assembly and a portion of the support structure between the attachment points of the first and second pairs of arms to the support structure. The third pair of arms is preferably not connected to the backboard. This may allow, for example, the backboard to be supported by the first and second pairs of arms, and the rim assembly to be supported by the second and third pairs of arms.

Yet another aspect is a basketball system that may include a basketball backboard with an opening that is sized and configured to allow the rim assembly to be directly connected to the support structure. For example, the rim may be connected to the rim assembly and the rim assembly may be connected to the connecting structure that interconnects the basketball goal to the support structure. Advantageously, because the rim may be directly attached to the connecting structure, that may help prevent damage to the rim, backboard and other portions of the basketball system. In addition, this may allow forces applied to the rim to be directly transmitted to the connecting and support structures, and less force applied to the backboard and/or backboard frame.

A further aspect is a basketball system that may include a basketball goal with a backboard and a rim; a support structure that is sized and configured to support the basketball goal above a playing surface; a rim assembly that is connected to the rim; and a connecting structure that is sized and configured to connect to the basketball goal and the support structure. The connecting structure may include a first pair of arms with a first end connected to the backboard and a second end connected to the support structure. The connecting structure may also include a second pair of arms with a first end connected to the backboard and the rim assembly, and a second end connected to the support structure. In addition, the connecting structure may include a third pair of arms with a first end connected to the rim assembly and a second end connected to the support structure. The basketball system may further include a rim bracket. The rim assembly is preferably at least substantially disposed on a first side of the backboard and the rim bracket is preferably at least substantially disposed on a second side of the backboard. In addition, the rim bracket may be connected to the rim assembly by a first set of one or more fasteners, connected to the backboard and the second pair of arms by a second set of one or more fasteners, and/or connected to the third pair of arms by a third set of one or more fasteners.

A still further aspect is a basketball system that may include a basketball goal with a backboard and a rim assembly; a support structure that is sized and configured to support the basketball goal above a playing surface; and a connecting structure that is sized and configured to connect to the basketball goal and the support structure. The connecting structure may include a first set of one or more connecting members connected to the backboard and the support structure; a second set of one or more connecting members connected to the backboard, the rim assembly and the support structure; and a third set of one or more connecting members connected to the rim assembly and the support structure.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

The present invention is generally directed towards a basketball system. The principles of the present invention, however, are not limited to basketball systems. It will be understood that, in light of the present disclosure, the basketball system disclosed herein can be successfully used in connection with other types of support structures, sporting equipment and the like.

Additionally, to assist in the description of the basketball system, words such as top, bottom, front, rear, right and left are used to describe the accompanying figures, which are not necessarily drawn to scale. It will also be appreciated that the basketball system can be located in a variety of desired positions and locations. A detailed description of the basketball system now follows.

Figure 1:
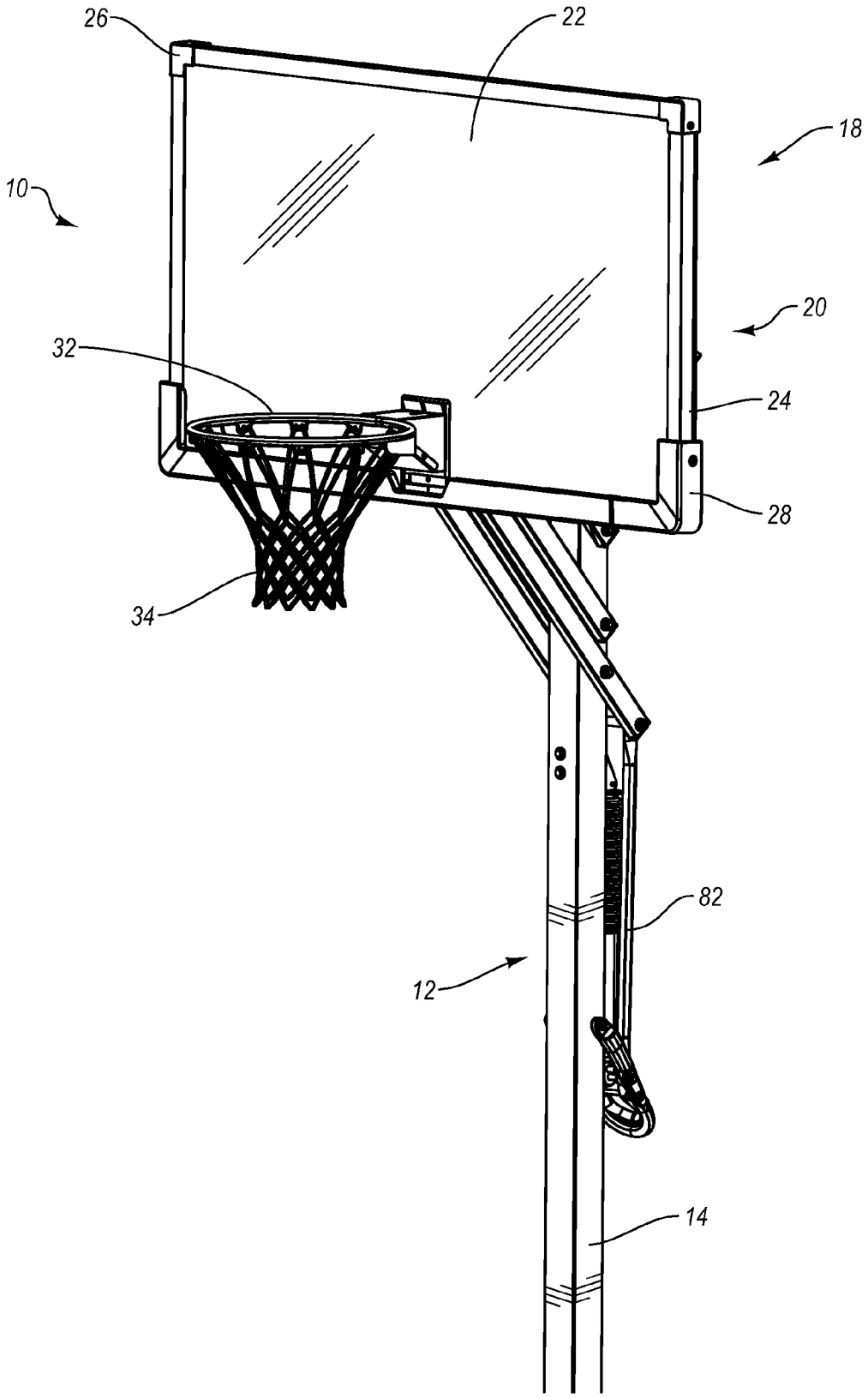
FIG. 1 is a front perspective view of an exemplary basketball system.

As seen in FIG. 1, the basketball system 10 may include a support structure 12 that is sized and configured to support the basketball system relative to a playing surface. The support structure 12 may consist of an elongated support member, such as a pole 14. The pole 14 may include one or more segments that are interconnected, which may facilitate shipping and transportation of the basketball system 10, or a single elongated pole. The pole 14 preferably has a hollow interior to decrease the weight of the support structure 12 and the pole may have a generally square or rectangular configuration as shown in FIG. 1. The pole 14 is preferably constructed from relatively strong and durable materials, such as steel, but it may also be constructed from other suitable materials. It will be appreciated that the pole 14 and/or the support structure 12 may have other suitable shapes, sizes, configurations and arrangements depending, for example, upon the intended use of the basketball system 10. For example, the support structure 12 could include multiple support poles or segments, the pole 14 could be disposed at various angles, and the like.

The basketball system 10 may be part of a portable basketball system that is capable of being moved or a permanent system that is intended to remain in a fixed location. For example, the support structure 12 may be connected to a base to form part of a portable basketball system. The support structure 12 may also be connected to the ground to form an in-ground or permanent basketball system 10. Advantageously, the basketball system 10 may be used in connection with either a portable or permanent basketball system.

The basketball system 10 may include a basketball goal 18, which may include a basketball backboard 20. The backboard 20 may consist of a single structure or it may include multiple components that are interconnected. For example, the backboard 20 may include a rebound member 22 and a frame 24. The rebound member 22 may consist of a sheet of acrylic material with a generally planar front surface and the rebound member may be generally transparent or translucent to allow light to pass through the backboard 20. The rebound member 22, however, could be constructed from other suitable materials and it may be opaque if desired. The frame 24 is preferably sized and configured to support the rebound member 22. For example, the frame 24 could be disposed proximate the outer surface or perimeter of the rebound member 22. The frame 24 is preferably constructed from a relatively strong and durable material, such as steel, and the frame may be constructed from any suitable number of parts or components. Various portions of the frame 24 may be connected by brackets 26, if desired, and padding 28 or other protective materials or structures may be attached to the frame to help prevent damage to the backboard 20. The padding 28 may also help protect basketball players from injury if they inadvertently strike the backboard 20.

As shown in the accompanying figures, the backboard 20 may have a generally rectangular configuration with the rebound member 22 generally disposed within the frame 24. Preferably the front surface of the rebound member 22 is generally aligned with the front surface of the frame 24 so that the backboard has a generally planar front face, but the rebound member and frame do not have to be aligned. It will be appreciated that the backboard 20, rebound member 22 and frame 24 could have various suitable sizes, shapes, configurations and arrangements depending, for example, upon the intended use of the basketball system 10. In addition, the rebound member 22 and frame 24 could be part of a unitary structure, if desired, and constructed from the same material, such as plastic.

Figure 2:
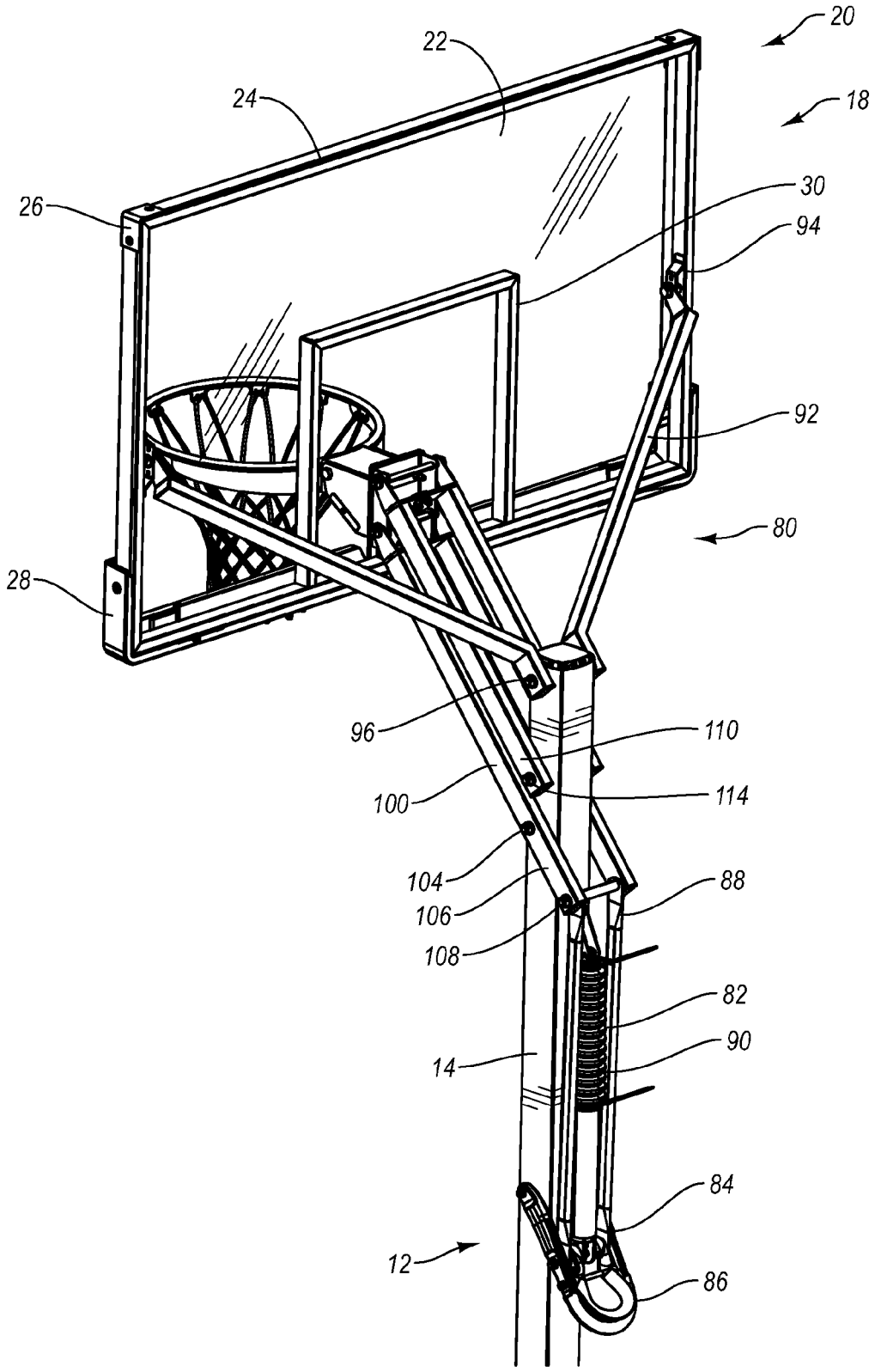
FIG. 2 is rear perspective view of the basketball system shown in FIG. 1.
Figure 3:
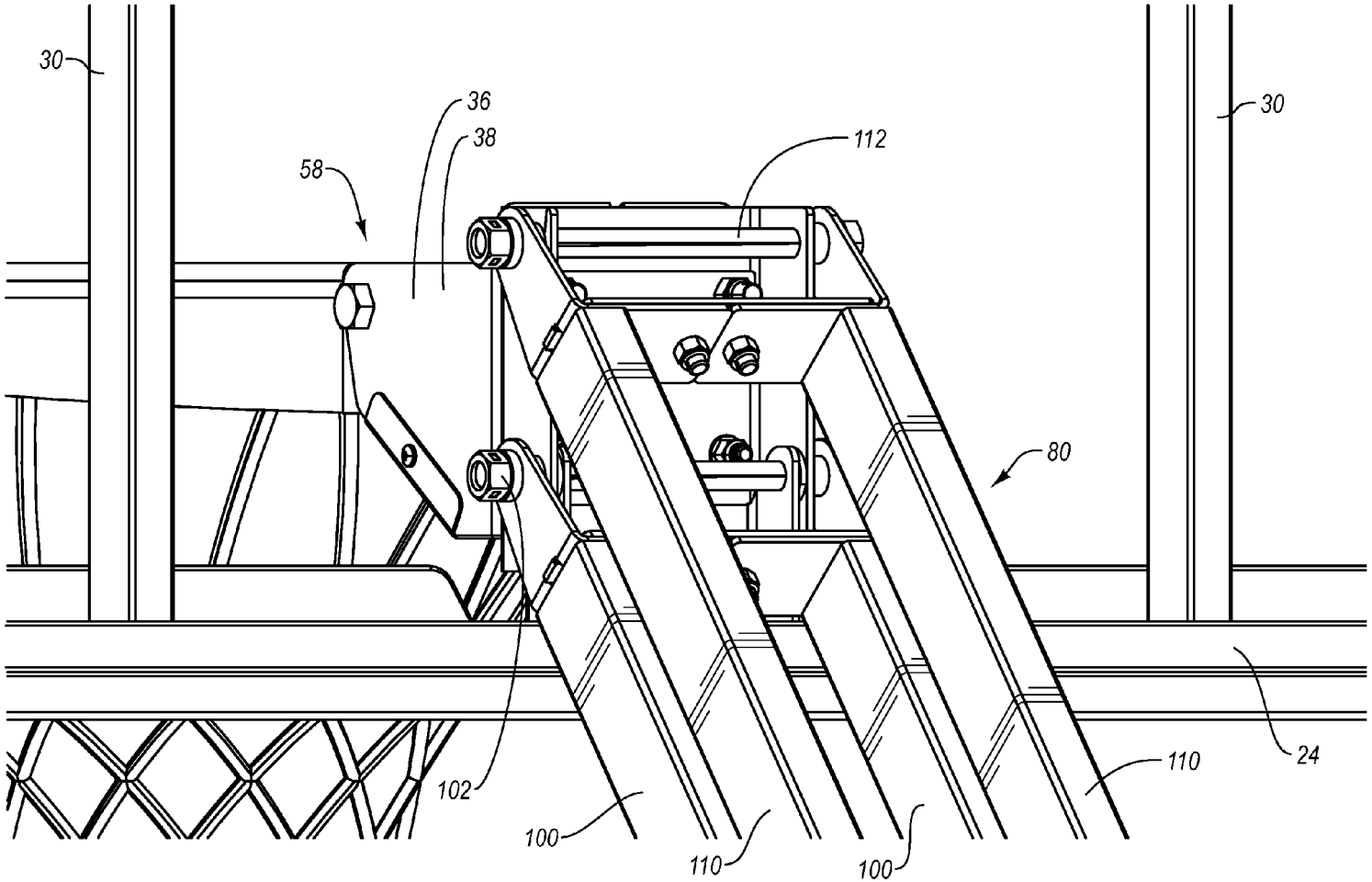
FIG. 3 is an enlarged perspective view of a portion of the basketball system shown in FIG. 2.
Figure 7:
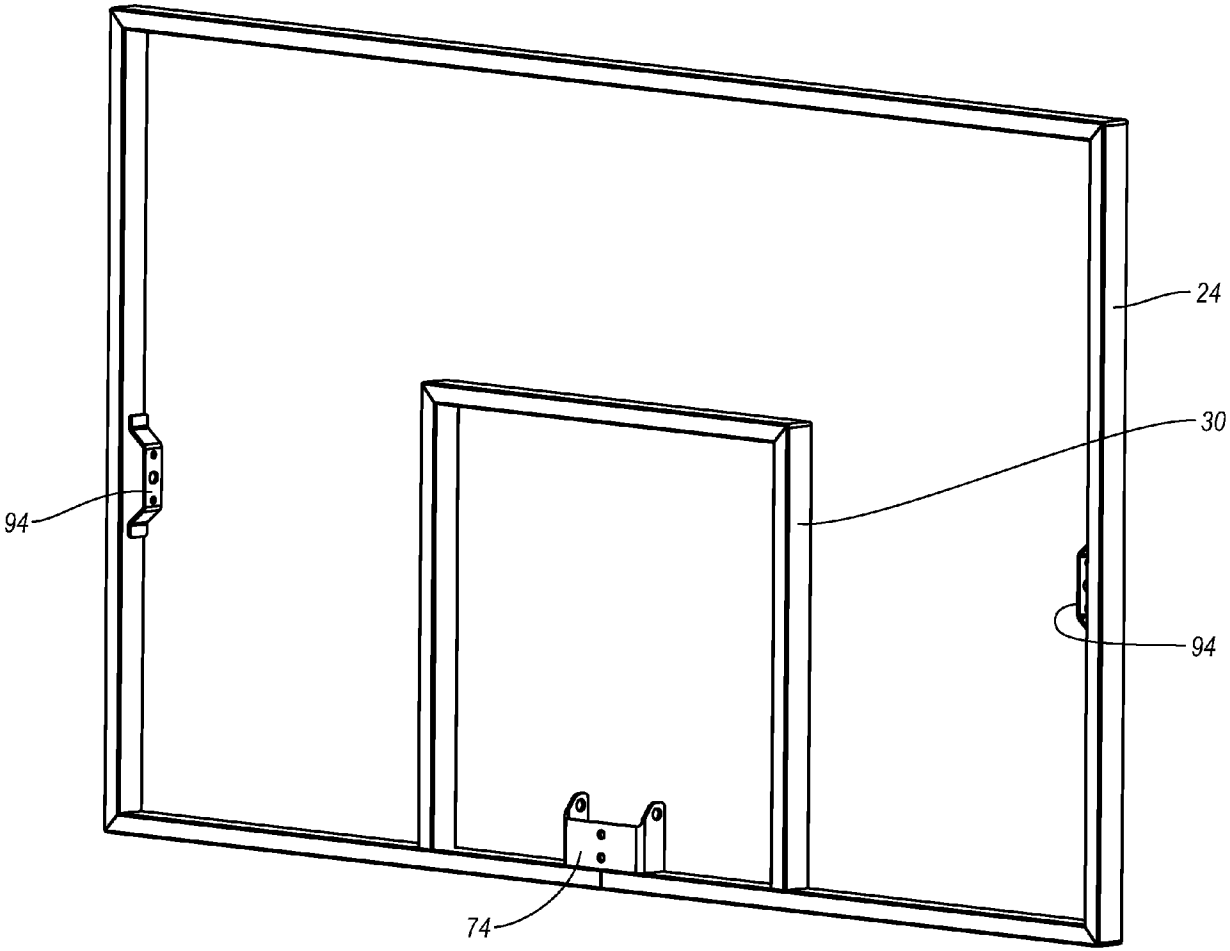
FIG. 7 is a front view of an exemplary backboard frame that may be used in connection with the basketball system.
Figure 4:
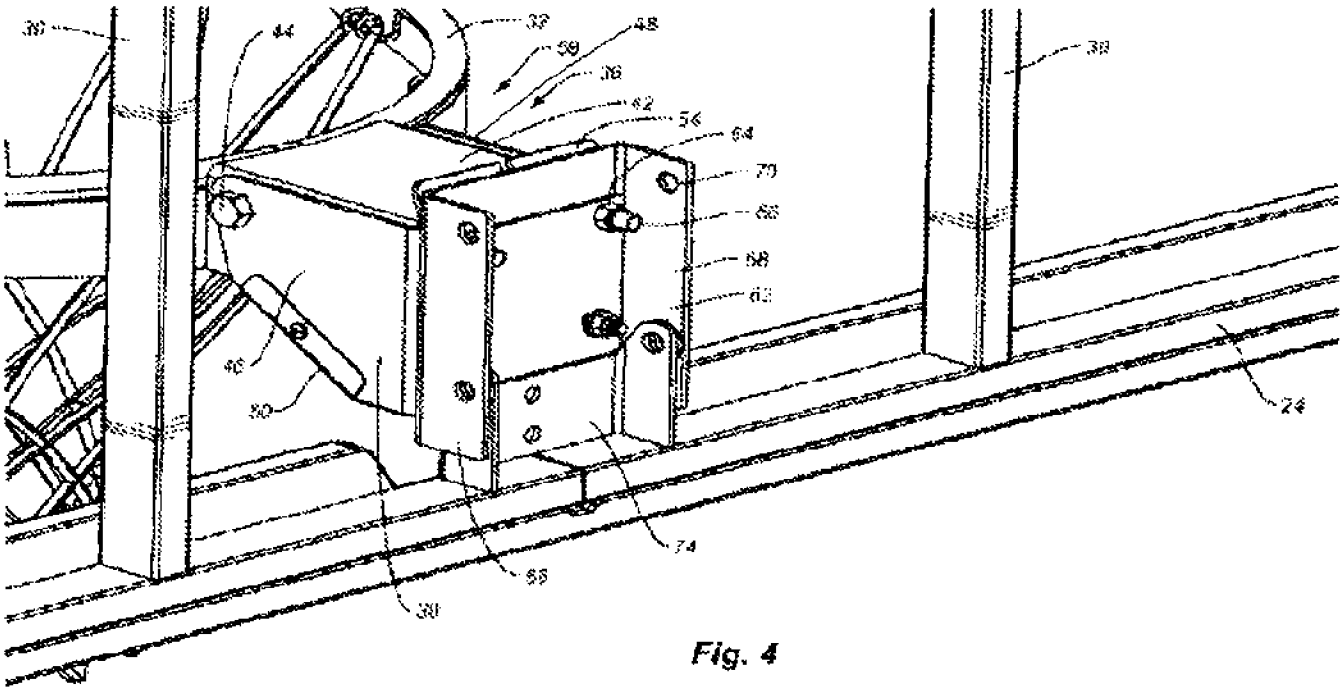

As best seen in FIGS. 2 and 7, the backboard 20 may include a center support structure 30. The center support structure 30, which could be part of the frame 24, is preferably sized and configured to support a center portion of the rebound member 22. For example, the center support structure 30 could have a generally square or rectangular shaped configuration and it could be connected to a lower portion of the frame 24. The center support structure 30 is preferably constructed from relatively strong and durable materials, such as steel, and it is preferably securely connected to the frame 24 by fasteners, welding and the like. If desired, the center support structure 30 could be integrally formed with the frame 24 or it may consist of one or more components connected to the frame.

Advantageously, the center support structure 30 may be sized and configured to be generally aligned with a target area of the backboard 20. For example, the basketball backboard 20 may include a generally square or rectangular target area that is disposed on the front surface of the rebound member 22 and the user may use the target to facilitate shooting the basketball. In particular, the user may use the target area to assist in aiming the basketball and the user may use the target area when using the backboard 20 while shooting the basketball. Because the center support structure 30 may be generally aligned with the target area, the center support structure may be generally hidden from view when the basketball system 10 is being used. Therefore, the rebound member 22 may be securely supported, but the center support structure 30 may be generally hidden from view. In addition, the center support structure 30 may not significantly limit light from being transmitted through the backboard. Thus, the center support structure 30 may be used to create an aesthetically pleasing backboard 20. However, as indicated above, the basketball goal 18 does not require the frame 24 and/or the center support structure 30.

Significantly, the center support structure 30 may help support the backboard 20 and prevent the backboard from undesirably moving or flexing. In particular, the center support structure 30 may be sized and configured to contact the center portion of the rebound member 22 and prevent the rebound member from undesirably moving or flexing. This may allow a rigid and sturdy backboard 20 to be created. The center support structure 30 could also have other suitable sizes, shapes, configurations and arrangements depending, for example, upon the size and shape of the backboard 20. For instance, the center support structure could be connected to other portions of the frame 24 and it could support other portions of the rebound member 22.

In addition, the center support structure 30 could be used to create the target area. Thus, instead of a target area being painted or otherwise disposed on the rebound member 22, the center support structure 30 may form the target area. Advantageously, this may eliminate the need to create a target area on the rebound member.

As shown in FIG. 1, the basketball goal 18 may include a rim 32 and a net 34 attached to the rim. The rim 32 may be pivotal or movable to create a break-away type rim. In particular, the rim 32 may be sized and configured to pivot or move downwardly when a force that exceeds a predetermined amount is applied to the rim. Thus, for example, if a player dunks the basketball or grasps the rim with a force that exceeds a certain amount, then the rim 32 may pivot or move downwardly. Advantageously, this may help prevent the rim 32 from being bent, deformed or otherwise damaged.

In greater detail, the rim 32 may be connected to a break-away type rim mechanism 36 that allows the rim to pivot or more downwardly when a significant force or impact is applied to the rim. The rim 32 may be securely attached to the break-away type rim mechanism 36 by welding, fasteners and the like. In addition, the rim 32 and break-away type rim mechanism 36 may be integrally formed if desired.

The break-away type rim mechanism 36 is preferably at least substantially disclosed within an enclosure 38. Advantageously, if the break-away type rim mechanism 36 is contained within the enclosure 38, then that may help protect the break-away type rim mechanism from damage. In addition, the enclosure 38 may help prevent any items or objects from being caught in the break-away type rim mechanism 36. Further, the enclosure 38 may help protect the break-away type rim mechanism 36 from the elements if the basketball system 10 is used outdoors.

Figure 5:
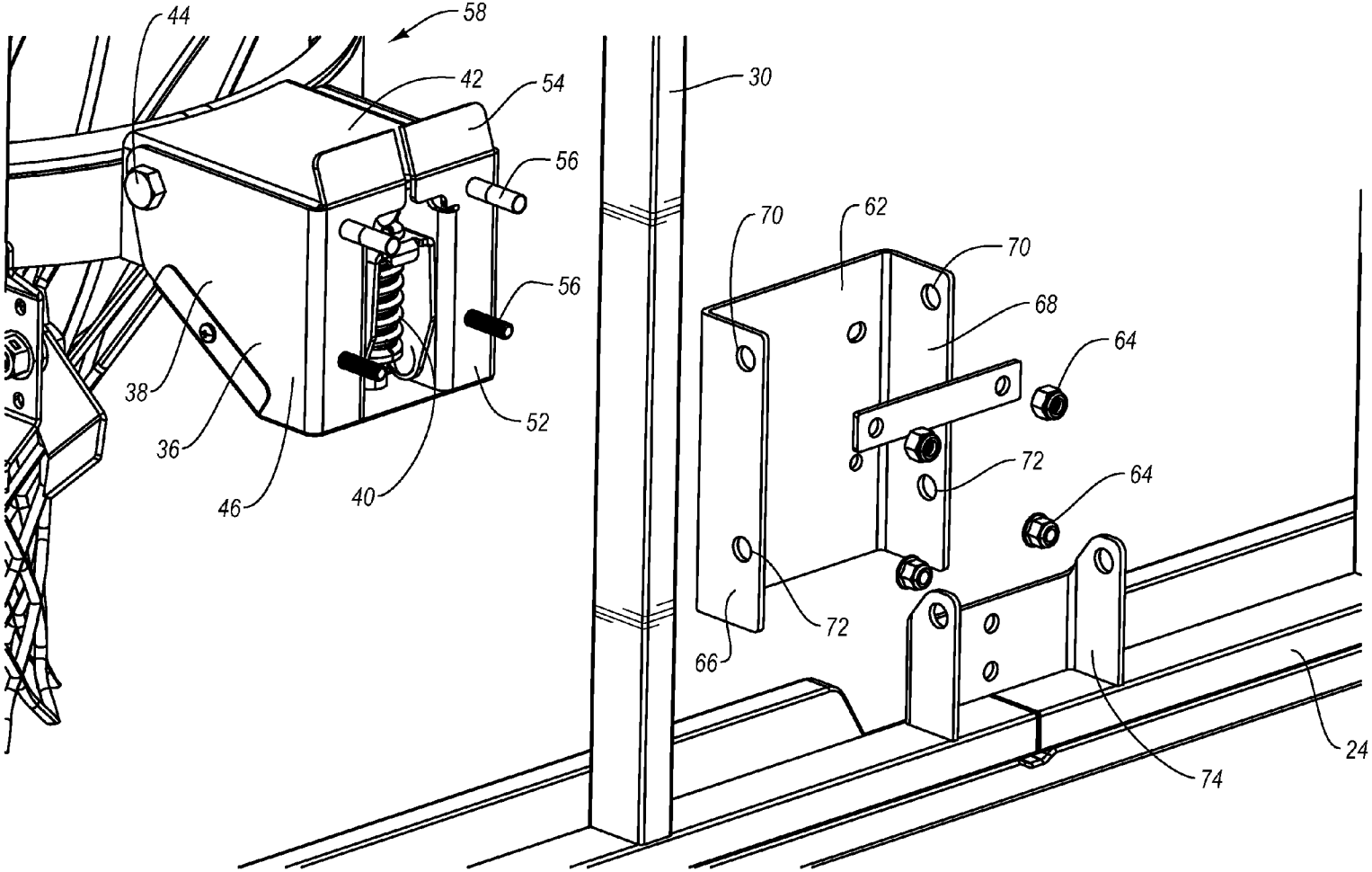
FIG. 5 is an enlarged, partially exploded, perspective view of a portion of the basketball system shown in FIG. 2.

As best seen in FIG. 5, the break-away type rim mechanism 36 may include a biasing member 40, such as a spring, that is sized and configured to maintain the rim 32 in the desired position. For example, the biasing member 40 may be sized and configured to maintain the rim 32 generally perpendicular to the backboard 20 and parallel to the playing surface when the game of basketball is being played or practiced. When a force greater than a predetermined amount is applied to the rim 32, the biasing member 40 of the break-away type rim mechanism 36 may allow the rim to move or pivot to help absorb the force applied to the rim. This may help prevent the rim 32 from being damaged. While the basketball system 10 preferably includes a break-away type rim 32, it will be appreciated that the break-away type rim is not required and any suitable type of rim may be used.

Figure 4:
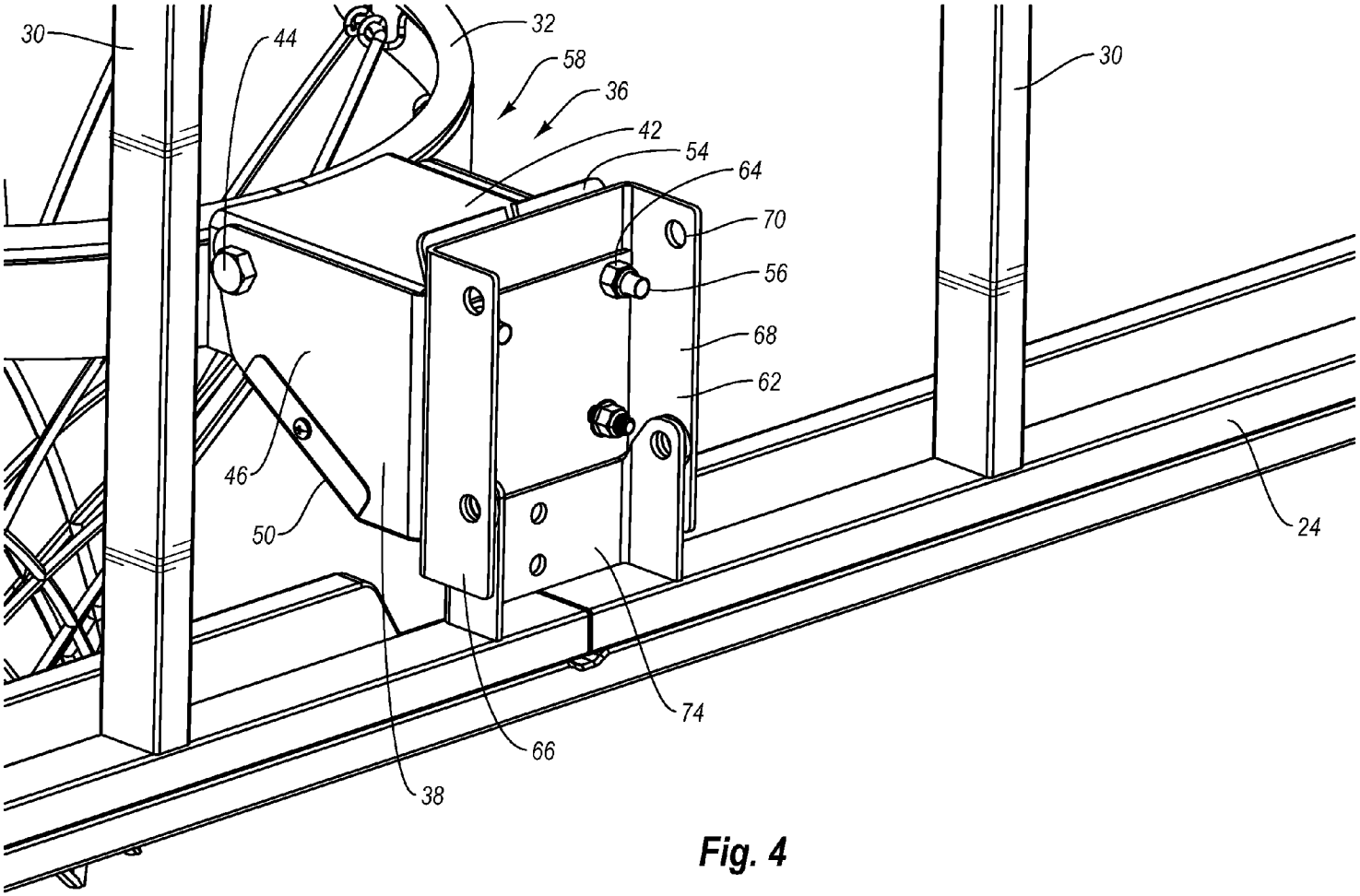
FIG. 4 is another enlarged perspective view of a portion of the basketball system shown in FIG. 2.

As best seen in FIGS. 4 and 5, the rim 32 may be connected to a rim plate 42, which may or may not form part of the enclosure 38. The rim plate 42 may include a generally planar upper surface that is generally aligned with the upper surface of the rim 32. The rim plate 42 may be used to space the rim 32 a desired distance away from the backboard 20. If the rim plate 42 and the enclosure 38 are different structures, they may be interconnected by, for example, a fastener 44. The rim plate 42 and enclosure 38, however, do not have to be interconnected.

The enclosure 38 may include a first side wall 46, a second side wall 48, a bottom portion 50 and a rear portion 52. The rear portion 52 of the enclosure 38 may include two generally upwardly extending flanges 54 and four generally rearwardly extending connectors or fasteners 56 that may be used to connect the rim 32 to the basketball system 10. It will be appreciated that the rim 32, enclosure 38, flanges 54 and fasteners 56 could have other suitable sizes, shapes, configurations and arrangements depending, for example, upon the type of rim 32, backboard 20 and intended use of the basketball system 10.

Advantageously, the rim 32, break-away type rim mechanism 36 and enclosure 38 may form part of a rim assembly 58 and the rim assembly may be used to connect the rim to the basketball system 10. It will be appreciated that the rim assembly 58 could have any desired number and arrangement of parts and components. It will also be appreciated that the rim assembly 58 may have various sizes, shapes, configurations and arrangements. It will further be appreciated that the rim assembly 58 is not required because, for example, the rim 32 could be directly connected to the backboard 20.

Figure 6:
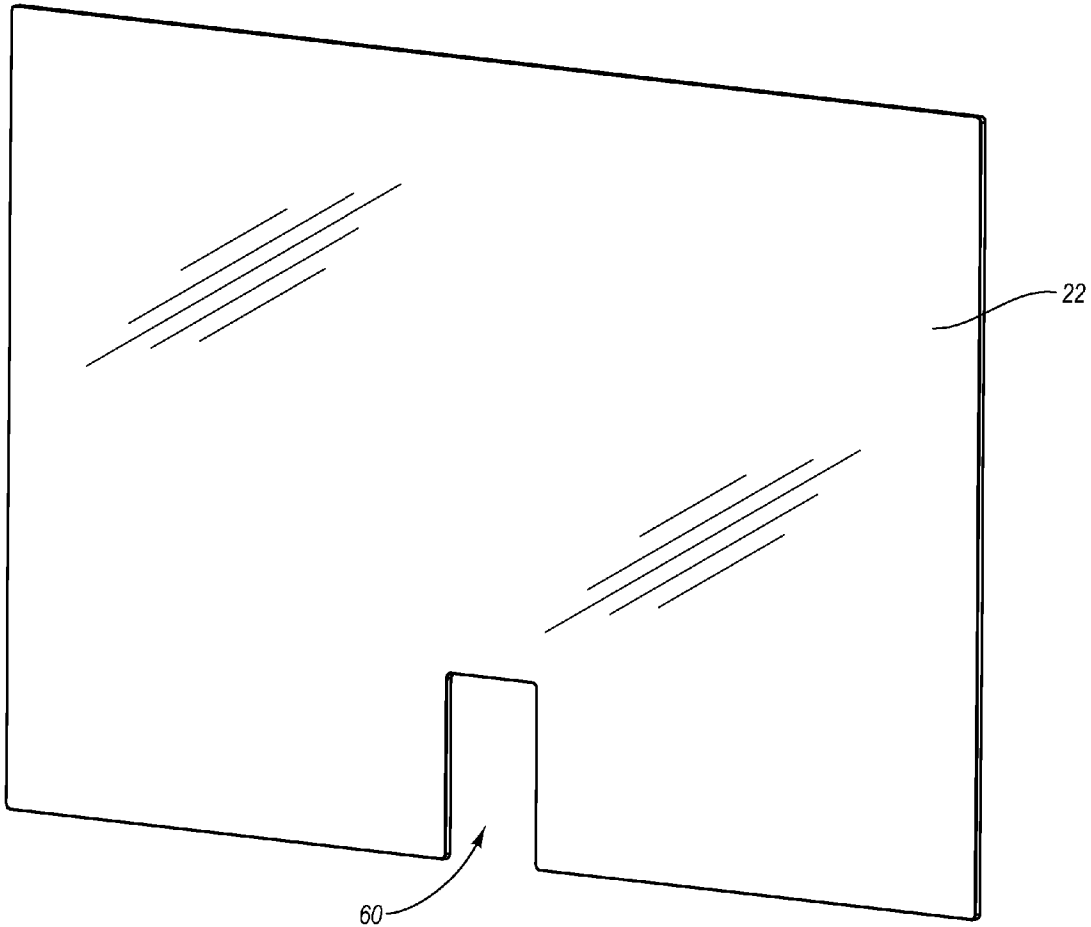
FIG. 6 is a front view of an exemplary rebound member that may be used in connection with the basketball system.

The rim assembly 58 is preferably disposed in a specific location relative to the backboard 20. In particular, as best seen in FIG. 6, the rebound member 22 of the backboard 20 may include an opening 60 that is sized and configured to receive or be disposed proximate at least a portion of the rim assembly 58.

In greater detail, as best seen in FIGS. 4 and 5, the rear portion 52 of the enclosure 38 of the rim assembly 58 may be disposed in or proximate the opening 60 in the rebound member 22. A rim bracket 62 may then be connected to the rearwardly extending fasteners 56. In particular, if the rearwardly extending fasteners 56 are bolts, then the fasteners may be inserted through openings in the rim bracket 62 and the nuts 64 may be connected to the bolts to connect the rim bracket to the rim assembly 58. It will be appreciated that the rim assembly 58 may be connected to the rim bracket 62 by any suitable type or manner of connection. It will also be appreciated that while the rim assembly 58 is preferably at least substantially disposed in front of the rebound member 22 and the rim bracket 62 is preferably at least substantially disposed behind the rebound member, the rim assembly and rim bracket could be disposed in other suitable configurations and arrangements. Further, while a portion of the rebound member 22 may be disposed between the upwardly extending flanges 54 of the rim assembly 58 and an upper portion of the rim bracket 62, this is not required.

As shown in FIGS. 4 and 5, the rim bracket 62 may include two outwardly extending flanges 66, 68 with an upper pair of openings 70 and a lower pair of openings 72. The lower pair of openings 72 of the rim bracket 62 may be connected to the frame 24. In particular, the lower pair of openings 72 may allow the rim bracket 62 to be to be connected to a bracket 74 that is connected to the frame 24 of the backboard 20.

The basketball system 10 may also include a connecting structure 80 that is sized and configured to connect the basketball goal 18 to the support structure 12. The connecting structure 80 preferably allows the height of the basketball goal 18 to be adjusted. In order to facilitate adjustment of the basketball goal 18, a height adjustment mechanism 82 may be used. As best seen in FIGS. 1 and 2, the height adjustment mechanism 82 may include a first end 84 that is connected to the support structure 12 by a handle 86 and a second end 88 that is connected to a portion of the connecting structure 80. The height adjustment mechanism 82 may include a biasing member 90, such as a spring, that is sized and configured to bias the basketball goal 18 into a desired position. The biasing member 90 may also be used to help maintain the basketball goal 18 in a desired position. It will be appreciated that the height adjustment mechanism 82 may have a variety of sizes, shapes, configurations and arrangements depending, for example, upon the size, shape, configuration, arrangement and/or intended use of the basketball system 10. It will also be appreciated that the height of the basketball goal 18 does not have to be adjustable and a height adjustment mechanism 82 is not required.

As best seen in FIG. 2, the connecting structure 80 preferably includes a number of support members or arms that connect the support structure 12 and the basketball goal 18. In particular, the connecting structure preferably includes three pairs of arms that connect the support structure 12 and the basketball goal 18. The arms are preferably constructed from relatively strong and durable materials, such as steel, and the arms are preferably lightweight to help decrease the weight of the connecting structure 80. For example, the arms may be constructed from hollow steel tubes that have a generally rectangular cross-section. It will be appreciated that the arms could have other suitable sizes, shapes, configurations and arrangements depending, for example, upon the size, shape, configuration and arrangement of the support structure 12, basketball goal 18 and/or intended use of the basketball system 10. It will also be appreciated that the arms could be constructed from any suitable number of parts and components.

In greater detail, as shown in FIG. 2, the connecting structure 80 may include a first pair of arms 92 interconnecting the support structure 12 and the basketball goal 18. One end of the first pair of arms 92 is preferably connected to the frame 24 of the basketball goal 18 and the other end of the arms is preferably connected to the support structure 12. In particular, the one end is preferably pivotally connected to an outer portion of the frame 24 by brackets 94 and the other end is preferably pivotally connected to an upper portion of the support structure 12 by a fastener 96 such as a bolt. The first pair of arms 92 is preferably connected to the outer portion of the frame 24 so that the perimeter of the backboard 20 is securely supported. In addition, the first pair of arms 92 is preferably connected proximate a middle or upper portion of the frame 24 so that the upper and/or outer portions of the backboard 20 securely supported. Further, while the first pair of arms 92 is preferably pivotally connected to the support structure 12 and the frame 24 to allow the height of the basketball goal 18 to be readily adjusted, the arms may be connected in any suitable manner or fashion.

The connecting structure 80 may also include a second pair of arms 100 connecting the support structure 12 and the basketball goal 18. The second pair of arms 100 preferably includes a first end that is connected to the basketball goal 18 and a second end that is connected to the support structure 12. In particular, the first end of the second pair of arms 100 is preferably connected to a lower portion of the frame 24 of the basketball goal 18. More specifically, the first end of the second pair of arms 100 is preferably connected to the frame bracket 74 disposed proximate a central portion of the frame 24 by a fastener 102, such as a bolt. Advantageously, the first end of the second pair of arms 100 may also be connected to the rim bracket 62 by the fastener 102. Thus, the second pair of arms 100 may be connected to the frame 24 and the rim bracket 62, which may allow the second pair of arms 100 to help support the backboard 20 and the rim assembly 58.

The other end of the second pair of arms 100 may be connected to the support structure 12 by a fastener 104. The ends of the second pair of arms 100 are preferably pivotally connected to the basketball goal 18 and the support structure 12 by the fasteners 102, 104, respectively, to allow the height of the basketball goal to be readily adjusted. In addition, the end of the second pair arms 100 may extend beyond the support structure 12 to allow the height adjustment mechanism 82 to be connected to the connecting structure 80. For example, as seen in FIGS. 1 and 2, the second pair of arms 100 may include rearwardly extending portions 106 that are connected to the height adjustment mechanism 82 by a fastener 108. It will be appreciated that the height adjustment mechanism 82 could be connected to any suitable portions of the connecting structure 80, and the height of the basketball goal 18 does not have to be adjustable. It will further be appreciated that the arms 100 may be connected to the basketball goal 18 and support structure 12 in other suitable manners and fashions.

The connecting structure 80 may also include a third pair of arms 110, which are preferably disposed between the first pair of arms 92 and the second pair of arms 100. The third pair of arms 110 preferably includes a first end that is connected to the rim bracket 62 and a second end that is connected to the support structure 12. Specifically, the first end of the arms 110 is preferably connected to the upper pair of openings 70 in the flanges 66, 68 of the rim bracket 62 by a fastener 112. The second end of the arms 110 is preferably connected to the support structure 12 by a fastener 114.

As shown in the accompanying figures, the second and third pairs of arms 100, 110 are preferably spaced apart by a generally constant distance and disposed in a generally parallel configuration. In addition, the distance separating the connection of the arms 100, 110 to the rim bracket 62 is preferably generally equal to the distance separating the connection of the arms to the support structure 12. Thus, this portion of the arms 100, 110, rim bracket 62 and support structure 12 may have a generally parallelogram configuration. Advantageously, if the height of the basketball goal 18 is adjusted, then the arms 100, 110, rim bracket 62 and support structure 12 may help maintain the backboard 20 generally perpendicular to the playing surface and the rim 32 generally parallel to the playing surface.

The first pair of arms 92 may also be disposed generally parallel to the second and/or third pairs of arms 100, 110. In addition, the vertical distances separating the connection of the ends of the arms 92 to the frame 24 to the connection of the arms 100, 110 to the rim bracket 62 may be generally equal to the distances separating the connection of the arms 92, 100, 110 to the support structure. Thus, the first pair of arms 92 may have a parallelogram configuration with the first pair of arms 100, the second pair of arms 110, the rim bracket 62 and a portion of the support structure 12. It will be appreciated, however, the first pair of arms 92, the second pair of arms 100 and/or the third pair of arms 110 do not have to be disposed in generally parallel configurations, separated by generally constant distances, have generally parallelogram configurations or the like. Instead, the arms 92, 100, 110 may have other suitable sizes, shapes, configurations and arrangements depending, for example, upon the intended use of the basketball system 10.

Advantageously, the connecting structure 80 may allow the basketball goal 18 to be securely connected to the support structure 12. In addition, the connecting structure 80 may allow the rim 32 and/or rim assembly 58 to be securely connected to the backboard frame 24 and the support structure 12. The connecting structure 80 may also allow forces applied to the rim 32 to be directly transmitted to and absorbed by the support structure 12. Further, the connecting structure 80 may help decrease or prevent forces applied to rim 32 from being transmitted to the backboard 20, rebound member 22 and/or frame 24. In particular, because the rim assembly 58 may be connected to the support structure 12 by the connecting structure 80, forces applied to the rim 32 may be directly transmitted to the support structure 12. Thus, forces or stresses on the backboard 20 may be decreased, which may help prevent the backboard from being damaged.

In greater detail, the first and second pairs of arms 92, 100 may help support the basketball goal 18 in the desired position. The second and third pairs of arms 100, 110 may help support the rim assembly 58 in the desired position. When a force is applied to the rim 52, the force may be transmitted by the rim assembly 58 directly to the second and third arms 100, 110 of the connecting structure 80. Because the second and third arms 100, 110 are connected to the support structure 12, the forces may then be directly transmitted to the support structure. This may reduce or eliminate forces or stresses on the rebound member 22 and/or the frame 24. In particular, because the rim assembly 58 may be disposed within the opening 60 in the rebound member 22, forces applied to the rim 32 are generally not transmitted to the rebound member and they may help prevent damage or breakage of the rebound member. Additionally, forces applied to the frame 24 may be significantly reduced because the rim assembly 58 is connected to both the second and third pairs of arms 100, 110, which may help prevent damage, such as bending or deforming, to the frame.

Because the rim assembly 58 is directly connected to the second and third arms 100, 110 of the connecting structure by the rim bracket 62, the rim 32 may have increased support. Significantly, this may create a rim 32 with enhanced qualities because the rim may be maintained in a fixed location. In addition, because forces applied to the rim 32 are not directly transmitted to the rebound member 22, that may help prevent the rebound member from breaking or being damaged. Further, significantly less force may be applied to the backboard frame 24 because the rim assembly 58 is connected to both the second and third pairs of arms 100, 110.

It will be appreciated that the connecting structure 80 may have a variety of different sizes, shapes, configurations and arrangements depending, for example, upon the size and configuration of the basketball goal 18 and/or support structure 12. Thus, while the connecting structure 80 shown in the accompanying figures illustrates the first pair of arms 92 disposed at an angle, and the second and third pairs of arms 100, 110 generally aligned and separated by the width of the pole 14, the arms and connecting structure could have other suitable sizes, shapes, configurations and arrangements. In addition, the connecting structure 80 does not require pairs of arms 92, 100 and/or 110, and the connecting structure does not require a symmetrical configuration. For instance, the rim assembly 58 may be connected to the support structure 12 by only a single upper arm and a single lower arm. Therefore, one of ordinary skill in the art will appreciate that the basketball system 10 may include various components in different configurations and arrangements, and the accompanying figures illustrate an exemplary embodiment of the basketball system 10.

One of ordinary skill in the art will also appreciate that the basketball system 10 can include other features, aspects, components and the like. In addition, one of ordinary skill in the art will appreciate that the basketball system 10 could have other suitable shapes, sizes, configurations and arrangements. For example, the basketball system 10 may include features, aspects, components and the like, or have other shapes, sizes, configurations and arrangements, such as disclosed in U.S. Pat. Nos. 5,695,417; 5,879,247; 6,077,177; 6,120,396; 6,155,938; 6,135,901; 6,142,891; 6,273,834; 6,419,597; 6,419,598; 6,402,644; 6,422,957; 6,645,095; and 6,699,146; and Pending U.S. patent application Ser. No. 11/500,791, which was filed on Aug. 7, 2006. These patents and applications are incorporated by reference in their entireties.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a basketball goal including a backboard with a backboard frame to which a rebound member is attached, and wherein the rebound member defines an opening;

a support structure that is sized and configured to support the basketball goal above a playing surface;

a rim assembly that includes a rim, the rim assembly further including a break-away rim mechanism that comprises:

an enclosure to which the rim is rotatably connected, wherein a rear portion of the enclosure is disposed in the opening defined by the rebound member; and a biasing member disposed within the enclosure and connected to the rim and to the enclosure so as to resist movement of the rim relative to the enclosure;

a rim bracket that connects directly to the rear portion of the enclosure such that no substantial portion of the rebound member resides between the rim bracket and the rim assembly; and a connecting structure that is sized and configured to connect to the basketball goal and the support structure, the connecting structure comprising:

a first set of connecting members that each include a first end and a second end, the respective first ends being pivotally connected to the backboard and the respective second ends being pivotally connected to the support structure;

a second set of connecting members that each include a first end and a second end, the respective first ends of the connecting members of the second set being pivotally connected to the rim bracket and the second set of one or more connecting members being pivotally connected to the support structure at a location between the respective first ends and the respective second ends of the connecting members of the second set; and a third set of connecting members that each include a first end and a second end, the respective first ends of the connecting members of the third set being pivotally connected to the rim bracket and the respective second ends of the connecting members of the third set being pivotally connected to the support structure.

2. The basketball system as in claim 1, further comprising a height adjustment mechanism connected to the second ends of the connecting members in the second set of connecting members, wherein the height adjustment mechanism includes a biasing mechanism configured to bias the basketball goal into a desired position, and to maintain the basketball goal in a desired position.

3. The basketball system as in claim 1, wherein the enclosure within which the biasing member resides is substantially disposed in front of the backboard.

4. The basketball system as in claim 1, wherein the biasing member resides in a substantially vertical orientation.

5. The basketball system as in claim 4, wherein the first set of connecting members are connected to an upper portion of the backboard frame and the second of connecting members are connected to a lower portion of the backboard frame.

6. The basketball system as in claim 1, wherein the rim assembly is at least substantially disposed on a first side of the backboard and the rim bracket is at least substantially disposed on a second side of the backboard.

7. The basketball system as in claim 1, wherein one set of connecting members and another set of connecting members are disposed in a generally parallel configuration with respect to each other and are separated from each other by a generally constant distance.

8. The basketball system as in claim 1, wherein the connecting members in the third set of connecting members are shorter than the connecting members in the second set of connecting members.

9. The basketball system as recited in claim 1, wherein the basketball system further comprises one or more fasteners extending into a portion of the rim bracket, through a plane defined by a perimeter of the rebound member, and into a portion of the rim assembly.

10. The basketball system of claim 1, wherein the rim assembly is connected to a rim plate of the rim, and the enclosure includes a pair of flanges that extend upwardly past the rim plate.

11. A basketball system comprising:

a basketball goal including a rebound member that defines an opening;

a support structure that is sized and configured to support the basketball goal above a playing surface;

a rim bracket;

a rim assembly that is connected directly to the rim bracket such that no portion of the rebound member resides between the rim bracket and the rim assembly the rim assembly comprising:

a rim;

a rim plate connected to the rim;

an enclosure to which the rim plate is rotatably connected, wherein a rear portion of the enclosure is disposed in the opening defined by the rebound member; and a biasing member disposed within the enclosure, the biasing member connected to the rim plate and to the enclosure so as to resist rotational movement of the rim relative to the enclosure, and wherein, a horizontal position of the rim relative to the rebound member is fixed.

12. The basketball system as recited in claim 11, wherein the enclosure includes a first side wall, a second side wall, a bottom portion, and rear portion, and wherein the rim plate serves as a top of the enclosure.

13. The basketball system as recited in claim 11, wherein the rear portion of the enclosure comprises a pair of upwardly extending flanges.

14. The basketball system of claim 11, wherein the enclosure within which the biasing member resides is substantially disposed in front of the rebound member.

15. The basketball system of claim 11, wherein the biasing member resides in a substantially vertical orientation.

16. The basketball system of claim 11, wherein there is no substantial contact between the rim assembly and the rebound member.

17. The basketball system of claim 11, wherein the location of the rotatable connection between the enclosure and the rim plate relative to the rebound member is fixed.

18. The basketball system of claim 11, wherein the rim assembly is configured and arranged such that movement of the rim is confined to rotational motion.

19. The basketball system of claim 11, further comprising a backboard frame to which the rebound member is attached, wherein the backboard frame includes a center support structure.

20. The basketball system of claim 19, wherein the backboard frame includes a frame bracket to which the rim bracket is attached.

21. The basketball system as recited in claim 11, further comprising a connecting structure that is sized and configured to connect the basketball goal and the support structure to each other, wherein the connecting structure is configured to be rotatably connected to the rim bracket.

22. The basketball system as recited in claim 21, further comprising a height adjustment mechanism configured to be connected to the connecting structure, the height adjustment mechanism being operable to change a height of the basketball goal relative to a reference surface, and the height adjustment mechanism including a biasing mechanism configured to bias the basketball goal into a desired position, and to maintain the basketball goal in a desired position.

* * * * *

UNITED STATES PATENT AND TRADEMARK OFFICE

CERTIFICATE OF CORRECTION

PATENT NO. : 8,708,844 B2
APPLICATION NO. : 11/625677
DATED : April 29, 2014
INVENTOR(S) : Nye et al.

It is certified that error appears in the above-identified patent and that said Letters Patent is hereby corrected as shown below:

In the Drawings

Sheet 4 of 7, Fig. 4, insert reference number 48. (See Attached)

In the Specification

Column 2
Line 19, change “may also a support” to --may also include a support--

Column 7
Line 22, change “more” to --move--

Signed and Sealed this
Seventh Day of July, 2015

Michelle K. Lee

Michelle K. Lee
*Director of the United States Patent and Trademark Office*